US006691772B2

(12) United States Patent
Manaka

(10) Patent No.: US 6,691,772 B2
(45) Date of Patent: Feb. 17, 2004

(54) HEAT EXCHANGER

(75) Inventor: Hideaki Manaka, Oyamashi (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/198,356

(22) Filed: Jul. 19, 2002

(65) Prior Publication Data

US 2003/0037915 A1 Feb. 27, 2003

Related U.S. Application Data

(60) Provisional application No. 60/308,848, filed on Aug. 1, 2001.

(30) Foreign Application Priority Data

Jul. 19, 2001 (JP) ..... 2001-219851

(51) Int. Cl.[7] ..... F28D 1/00

(52) U.S. Cl. ..... 165/149; 165/173; 165/175; 180/68.4

(58) Field of Search ..... 165/149, 67, 173, 165/906, 480; 180/68.4

(56) References Cited

U.S. PATENT DOCUMENTS 5,265,672 A * 11/1993 Aoki ..... 165/149
5,546,761 A * 8/1996 Matsuo et al. ..... 165/173
5,607,012 A * 3/1997 Buchanan et al. ..... 165/173
5,732,767 A * 3/1998 Saperstein ..... 165/133
6,012,513 A * 1/2000 Iokawa et al. ..... 165/149
6,357,520 B1 * 3/2002 Kato et al. ..... 165/149

FOREIGN PATENT DOCUMENTS

| | | | |
|---|---|---|---|
| JP | 64-54688 | 4/1989 | |
| JP | 2-127982 | 10/1990 | |
| JP | 405248783 A * | 9/1993 | ..... 165/149 |
| JP | 9-126685 | 5/1997 | |
| JP | 11-83373 | 3/1999 | |

* cited by examiner

*Primary Examiner*—Terrell McKinnon
(74) *Attorney, Agent, or Firm*—Oblon, Spivak, McClelland, Maier & Neustadt, P.C.

(57) ABSTRACT

A heat exchanger includes a pair of hollow headers, a plurality of tubes communicated with the headers, corrugated fins disposed between adjacent tubes and at an outside of an outermost tube and a side plate disposed at an outside of an outermost corrugated fin. The header insertion end portion of the side plate is formed into the same or approximately the same cross-sectional peripheral configuration as that of an end portion of the tube, and the side plate fitting aperture is formed into the same configuration as that of the tube fitting aperture. This becomes unnecessary to form a special fitting configuration at the end portion of the side plate, and moreover the workability for forming the side plate fitting apertures and the tube fitting apertures can be enhanced, resulting in enhanced productivity, which in turn can reduce the manufacturing cost.

14 Claims, 5 Drawing Sheets

Background Art

HEAT EXCHANGER

This application claims priority to Japanese Patent Application No. 2001-219851 filed on Jul. 19, 2001 and U.S. Provisional Application No. 60/308,848 filed on Aug. 1, 2001, the disclosure of which is incorporated by reference in its entirety.

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/308,848 filed on Aug. 1, 2001 pursuant to 35 U.S.C. §111(b).

BACKGROUND OF THE INVENTION

1. Field of the Invention

The present invention relates to a metal heat exchanger such as the so-called multi-flow type aluminum heat exchanger suitably used for a car air-conditioning condenser and the like.

2. Prior Art

As the so-called multi-flow type heat exchanger such as a car air-conditioning condenser, a heat exchanger shown in FIGS. 9 and 10 is generally known. The heat exchanger includes a pair of hollow headers 101 and 101 arranged in parallel, a plurality of flat tubes 102 disposed between the headers 101 and 101 and connected thereto and corrugated fins 103 each disposed between the adjacent tubes 102. As shown in FIG. 10, each tube 102 is connected to the headers 101 such that both end portions of the tube 102 are brazed to the headers 101 in a state that the end potions are inserted into the circumferentially extending slit-shaped tube fitting aperture 104 formed in the opposed surfaces of the headers 101.

Furthermore a corrugated fin 103 is disposed at the outside surface of the outermost tube 102 in order to improve the heat exchange efficiency, and a side plate 105 is disposed at the outside surface of the corrugated fin 103 for the purpose of protecting the fin 103 and the like. As shown in FIG. 10, at both ends of this side plate 105, an outwardly protruded fitting portion 106 having a small width is formed respectively. This side plate 105 is integrally brazed to the headers 101 in a state that the fitting portion 106 is fitted in the side plate fitting aperture 107 having a narrow width formed in the opposed surfaces of the headers 101 and 101. The reference numeral 110 denotes a partitioning plate, 111 denotes an inlet pipe and 112 denotes an outlet pipe.

According to the heat exchanger having the aforementioned conventional structure, it is required to provide the protruded fitting portions 106 at both ends of the side plate 105. However, it is technically difficult to form such a protruded fitting portion 106 by end processing, resulting in deteriorated productivity and an increased cost.

Furthermore, it is required to form two different types of apertures in the external surface of each header 101, i.e., side plate fitting apertures 107 for receiving the protruded fitting portion 106 and the tube fitting apertures 104 for receiving the tube 102. In other words, it is required to use different tools for forming the side plate fitting apertures 107 and the tube fitting apertures 104, which results in deteriorated productivity and an increased cost.

The present invention is made in view of the aforementioned technical background and aims to provide a heat exchanger which is excellent in productivity and capable of decreasing the manufacturing cost by eliminating the necessity of forming a special fitting configuration at end portions of a side plate and enhancing the workability for forming side plate fitting apertures and tube fitting apertures.

Another purpose of the present invention will be apparent from the following embodiment.

SUMMARY OF THE INVENTION

According to the first aspect of the present invention, a heat exchanger includes a hollow header having a plurality of tube fitting apertures arranged in line, a plurality of tubes communicated with the header, each tube having one end fitted in a corresponding tube fitting aperture, a fin disposed at an outside of an outermost tube, and a side plate disposed at an outside of the fin, wherein the header is further provided with a side plate fitting aperture having the same or approximately the same configuration as that of the tube fitting aperture, wherein a header insertion end portion of the side plate is formed into a cross-sectional peripheral configuration corresponding to a cross-sectional peripheral configuration of the side plate fitting aperture, and wherein the header insertion end portion of the side plate is fitted in the side plate fitting aperture and secured thereto.

According to the second aspect of the present invention, a heat exchanger includes a pair of hollow headers arranged in parallel, a plurality of tubes disposed between the headers and communicated with the headers with opposite end portions fitted in tube fitting apertures formed in opposed surfaces of the pair of headers, fins disposed between adjacent tubes and at an outside of an outermost tube, and a side plate disposed at an outside of an outermost fin with opposite end portions fitted in side plate fitting apertures formed in opposed surfaces of the pair of headers, wherein a header insertion end portion constituting one of both end portions of the side plate is formed into the same or approximately the same cross-sectional peripheral configuration as that of an end portion of the tube, and wherein the side plate fitting aperture is formed into the same or approximately the same configuration as that of the tube fitting aperture.

In the heat exchanger according to the present invention, since the side plate fitting aperture and the tube fitting aperture formed in the headers have the same or approximately the same configuration, the aperture forming operations can be completed by forming a plurality of the same or approximately the same apertures in the header, and therefore it is not required to form a conventional side plate fitting apertures different from the tube fitting apertures. This enhances the workability of forming fitting apertures in the header, which in turn reduces the manufacturing cost. Furthermore, since the end portion of the side plate is formed into the same or approximately the same cross-sectional peripheral configuration as that of an end portion of the tube, it is not required to perform specific end portion processing to an end portion of the side plate for forming a protruded fitting portion which is technically difficult. Accordingly, the quality of product can be improved and the cost can be decreased because of the enhanced workability.

As the fin, it is preferable to use a corrugated fin constituted by an aluminum brazing sheet comprising a core member and brazing materials coated on one side or both sides of the core member.

It is preferable that the side plate is provided with a header inserting portion having a contacting piece vertically extending relative to the side plate, and wherein the side plate is secured to the header with a header fitting surface of the contacting piece fitted to an external surface of the header. In this case, since the joining area increases when the header fitting surface of the contacting piece is secured to the external surface of the header, the joining strength increases notably. Furthermore, the existence of the contacting piece effectively prevents the contraction in the right-and-left direction (the longitudinal direction of the side plate) at the time of joining such as brazing.

It is preferable that the contacting piece is extended toward an inside of the side plate. In this case, it becomes unnecessary to newly provide a contacting piece fitting space at the tip end position of the external surface of the header (at the position located outside the side plate), resulting in a shortened header length, which in turn can meet the demand of compactness of a heat exchanger.

It is preferable that the contacting piece is formed by bending a cut-part of a widthwise edge portion of the header inserting end portion. In this case, there is a merit that the productivity can be improved regardless of the existence of the contacting piece.

It is preferable that the header inserting end portion of the side plate is formed into a tapered shape having a width decreasing toward a tip thereof. By forming the header inserting end portion into such a tapered shape, the insertion of the end portion of the side plate into the side plate fitting aperture can be performed smoothly, and the side plate can be fitted into the headers in a positioned state.

Alternatively, the header inserting end portion of the side plate may have a first tapered portion as an insertion guide at a tip end thereof and a second tapered portion for an insertion amount restricting portion at an inside position of the header inserting end portion. In this case, there are merits that it becomes easy to insert the side plate into the header and the assembly work can be done easily because of the regulated header insertion amount.

The side plate may have a width which is the same or approximately the same as a width of the tube and a thickness which is the same or approximately the same as a height of the tube.

The aforementioned heat exchanger can be preferably used for a condenser in a refrigeration cycle in which a refrigerant compressed by a compressor is condensed by a condenser, the condensed refrigerant is decompressed by passing through a decompressing device, and the decompressed refrigerant is evaporated by an evaporator and then returned to the compressor.

BRIEF DESCRIPTION OF THE DRAWINGS

The aforementioned objects and another objects as well as features and advantages will be more apparent from the following detailed description of the present invention with reference to the attached drawings: in which FIG. 1 shows a heat exchanger according to an embodiment of the present invention, wherein

FIG. 9 shows a conventional heat exchanger, wherein

DETAILED DESCRIPTION OF THE PREFERRED EMBODIMENTS

Figure 1A:
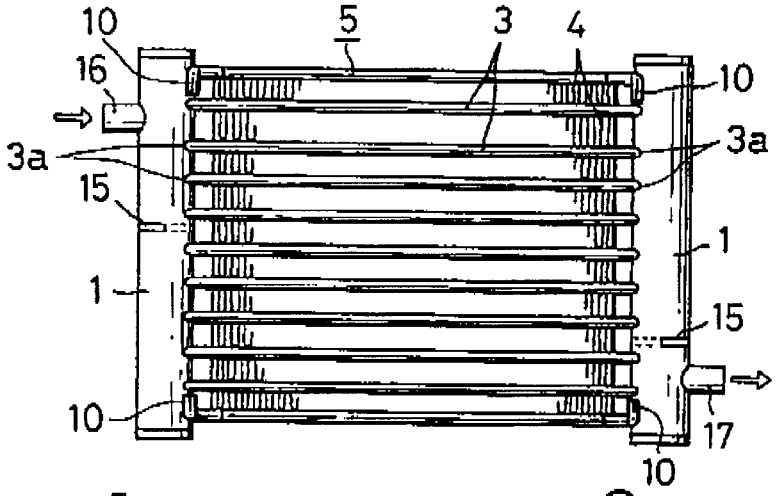
FIG. 1A is a front view thereof and FIG. 1B is a top view thereof.

A heat exchanger according to an embodiment of the present invention is shown in FIGS. 1 to 6. This heat exchanger is used as a condenser for car air-conditioners, and the reference numeral 1 denotes a hollow header, 3 denotes a tube, 4 denotes a corrugated fin, 5 denotes a side plate, 6 denotes a tube fitting aperture and 7 denotes a side plate fitting aperture.

Each of the pair of hollow headers 1 and 1 disposed in parallel is manufactured by forming an aluminum brazing sheet including a core member and brazing layers coated on both sides of the core member into a cylindrical shape with opposite side end portions abutted against each other and brazing the side end portions. The header is a hollow tube having a round cross-section. The header may be the so-called electric resistance welded pipe formed by joining the side edge portions by electric resistance welding, or may be a cylindrical aluminum extruded formed member with no side edge portions abutted against each other.

A partitioning plate 15 is disposed in the header 1, whereby the inner space of the header 1 is divided into a plurality of chambers arranged in the longitudinal direction of the header.

Figure 3:
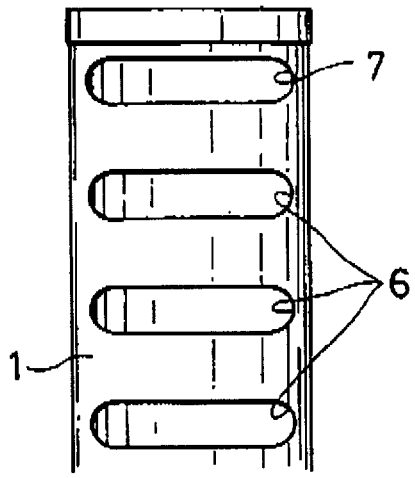
FIG. 3 is a side view showing one of the opposed sides of the headers.

In each peripheral wall of the opposed sides of the headers 1 and 1, as shown in FIG. 3, tube fitting apertures 6 are provided at certain intervals along the longitudinal direction of the header. Both ends of the tube 3 disposed between the headers 1 are inserted into the tube fitting apertures 6 and brazed thereto, whereby the tube 3 and the header 1 are communicated with each other.

The tube 3 is constituted by a multi-bored fat aluminum extruded member. In place of the extruded tube, the tube 3 may be the so-called electric resistance welded pipe.

Between the adjacent tubes 3 and at the outside of the outermost tube 3, a corrugated fin 4 is disposed respectively. This corrugated fin 4 is constituted by an aluminum brazing sheet including a core member and brazing layers coated on one side or both sides of the core member.

Furthermore, at the outside of the outermost side corrugated fin 4, the side plate 5 is disposed. Each end portion 5*a* of this side plate 5 is inserted into a circumferentially extending slit-shaped side plate fitting aperture 7 formed at both end portions of the opposed surfaces of the headers 1 and 1, and brazed thereto.

As shown in FIG. 3, the side plate fitting aperture 7 is formed to have the same configuration as that of the tube fitting aperture 6. Accordingly, forming fitting apertures in the header 1 can be done by forming a plurality of apertures each having the same configuration. As a result, it becomes unnecessary to form an aperture having a configuration different from that of the tube fitting aperture, resulting in enhanced workability of forming apertures in the header 1, which in turn can reduce the manufacturing cost.

Figure 2:
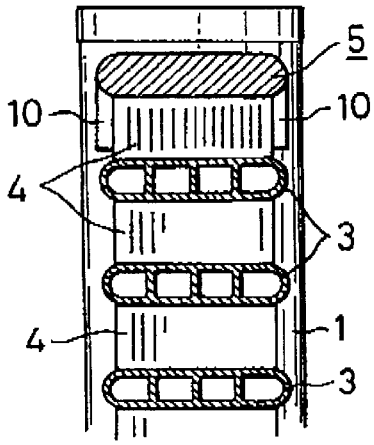
FIG. 2 is a cross-sectional view taken along the line 2—2 in FIG. 1B.

Furthermore, as shown in FIG. 2, the cross-sectional peripheral configuration of the end portion 5*a* of the side plate 5 is formed into a cross-sectional peripheral configuration identical to that of the end portion of the tube 3. As a result, it becomes unnecessary to perform special end processing for forming a fitting protrusion which is technically difficult to an end portion of the tube 3, resulting in enhanced product quality and workability, which in turn can reduce the manufacturing cost.

Figure 7:
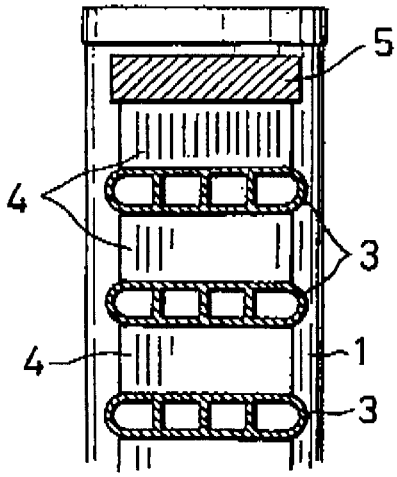
FIG. 7 is a cross-sectional view showing a modification of the cross-sectional configuration of the side plate and the tube.

The end portion 5*a* of the side plate 5 may be formed to have a cross-sectional peripheral configuration which is approximately the same cross-sectional peripheral configuration of the end portion of the tube 3. For example, the end portion 5*a* of the side plate 5 and the end portion of the tube 3 may be formed into a cross-sectional peripheral configuration as shown in FIG. 7. Namely, the width of the side plate 5 may be the same or approximately the same width of the tube 3, and the thickness of the side plate 5 may be the same or approximately the same height of the tube 3.

Figure 1B:
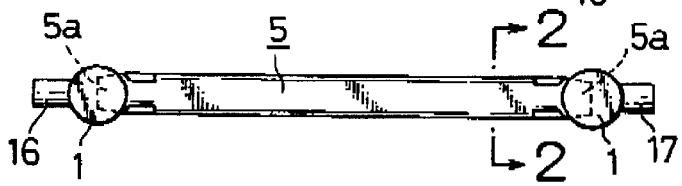
Figure 5:
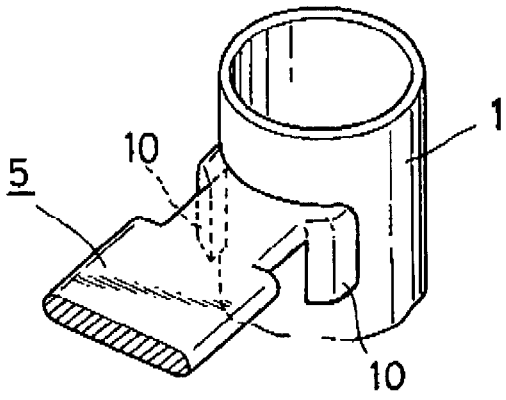
FIG. 5 is a perspective view showing the joining structure of the side plate and the header.
Figure 6:
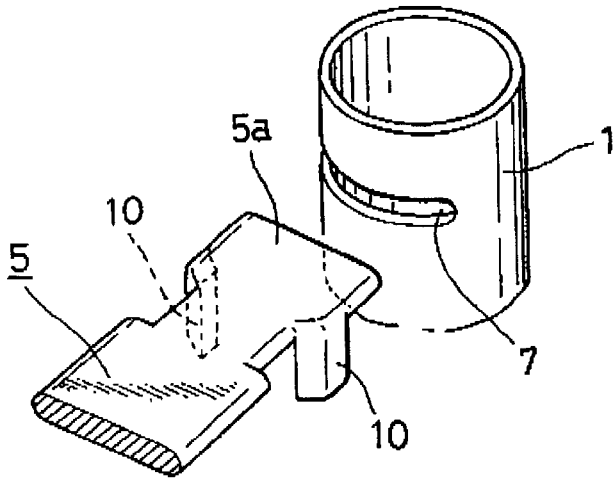
FIG. 6 is a perspective view showing the side plate and the header in a detached state.

At both end portions 5*a* of the side plate 5, contacting pieces 10 extended inwardly and vertically relative to the side plate 5 are provided (see FIGS. 1 and 6). As shown in FIG. 5, since these contacting pieces 10 are brazed to the header 1 with the fitting surfaces 10*a* of the contacting pieces fitted to the external surfaces of the header 1, the joining area of the header 1 and the side plate 5 increases, resulting in remarkably increased joining strength therebetween. Accordingly, a heat exchanger excellent in durability can be provided. Furthermore, since such contacting pieces 10 are protruded, the generation of contraction in the right-and-left direction of the heat exchanger (in the longitudinal direction of the side plate) at the time of brazing, etc., can be effectively prevented.

In addition, since the contacting piece 10 is formed by bending the cut-portion of the part of the widthwise edge portion of the side plate 5, the productivity is excellent in spite of employing additional protruded members.

Figure 4:
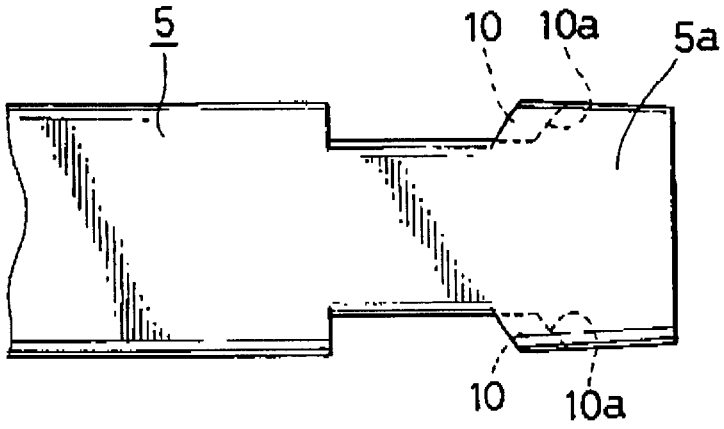
FIG. 4 is a top view showing the end portion of the side plate.

Furthermore, as shown in FIG. 4, the end portion 5*a* of the side plate 5 is formed into a tapered shape having a width which decreases toward the tip end. Accordingly, the insertion of the end portion into the side plate fitting aperture 7 can be performed smoothly, and a proper positioning to the header can be attained.

Figure 8:
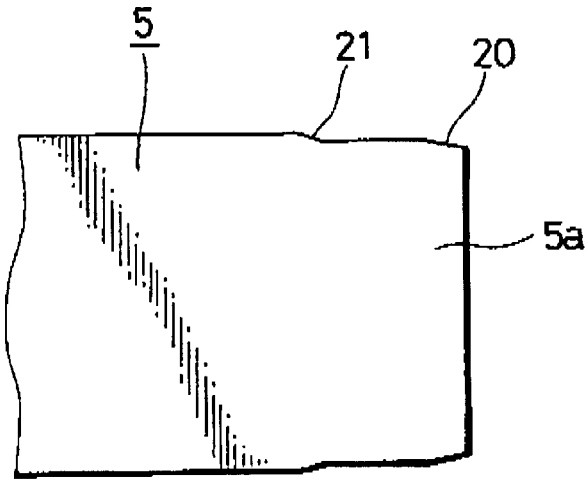
FIG. 8 is a top view showing a modification of the configuration of the end portion of the side plate.
Figure 9A:
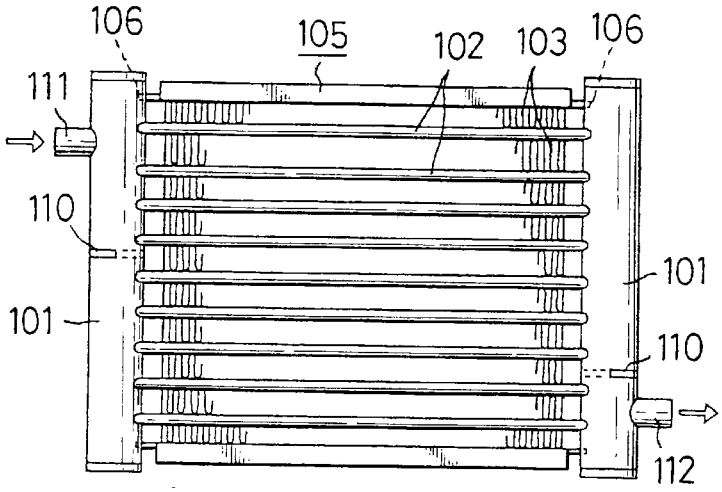
FIG. 9A is a front view thereof and FIG. 9B is a top view thereof.
Figure 9B:
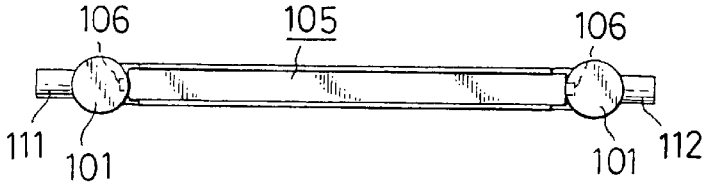
FIG. 9B Background Art
Figure 10:
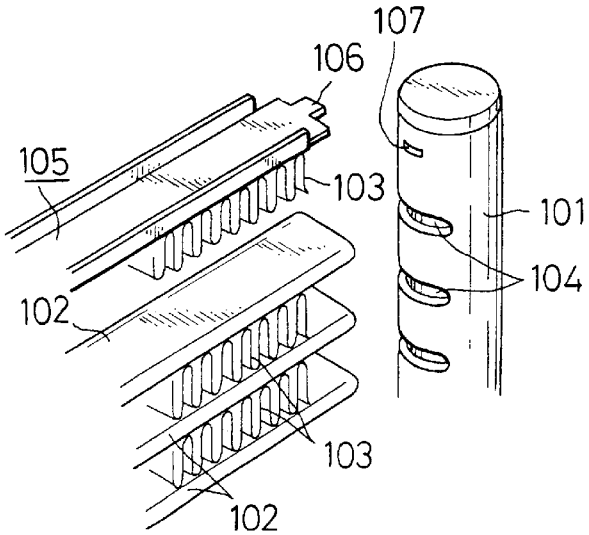
FIG. 10 Background Art
FIG. 10 is a perspective view showing each structural member of a conventional heat exchanger in a detached state.

As a tapered configuration of the end portion 5*a* of the side plate 5, as shown in FIG. 8, two stepped tapered configuration may be employed. That is, it may be constituted that the tip end portion 5*a* of the side plate 5 is formed into a tapered shape constituting a first tapered portion 20 and an inner portion of the tip end portion 5*a* is formed into a tapered shape constituting a second tapered portion 21. In the embodiment shown in FIG. 8, the inclination angle of the second tapered portion 21 is set to 10° relative to the axial direction of the side plate 5 (inclined by 10° relative to the axial direction).

In the aforementioned embodiment, although the structure in which the contacting pieces 10 are provided at the end portion 5*a* of the side plate 5 is adopted, the structure in which such contacting pieces are not provided may be adopt.

Now, in general, the heat exchanger according to the present invention is manufactured by provisionally assembling each component 1, 3, 4 and 5, and integrally secured by furnace brazing, etc.

As mentioned above, in the heat exchanger according to the present invention, since the side plate fitting aperture 7 and the tube fitting aperture 6 formed in the headers 1 have the same or approximately the same configuration, the aperture forming operations can be performed by forming a plurality of the same or approximately the same apertures in the header 1, and therefore it becomes unnecessary to form conventional side plate fitting apertures different from the tube fitting apertures. This enhances the workability of forming fitting apertures in the header 1, which in turn reduces the manufacturing cost.

Furthermore, since the end portion of the side plate 5 is formed into the same or approximately the same cross-sectional peripheral configuration as that of an end portion of the tube 3, it is not required to perform specific end portion processing to an end portion of the side plate 5 for forming a protruded fitting portion which is technically difficult. Accordingly, the quality of product can be improved and the cost can be reduced because of an enhanced workability.

The terms and descriptions in this specification are used only for explanatory purposes and the present invention is not limited to these terms and descriptions. The present invention permits any design-change, unless it deviates from the soul, if it is within the limits by which the claim was performed.

What is claimed is:

1. A heat exchanger used for a condenser in a refrigeration cycle in which a refrigerant compressed by a compressor is condensed by a condenser, the condensed refrigerant is decompressed by passing through a decompressing device, and the decompressed refrigerant is evaporated by an evaporator and then returned to said compressor, said heat exchanger comprising:

a pair of hollow headers arranged in parallel;

a plurality of tubes disposed between said headers and communicated with said headers with opposite end portions fitted in tube fitting apertures formed in opposed surfaces of said pair of headers;

corrugated fins disposed between adjacent tubes and at an outside of an outermost tube; and a side plate disposed at an outside of an outermost fin with opposite end portions fitted in side plate fitting apertures formed in opposed surfaces of said pair of headers, wherein said side plate fitting aperture is formed into the same or approximately the same configuration as that of said tube inserting aperture, wherein each of opposite end portions of said side plate is formed into a cross-sectional circumferential configuration corresponding to a cross-sectional circumferential configuration of said side plate fitting apertures, wherein said side plate is provided with opposite end portions each having a contacting piece vertically extending relative to said side plate, and said side plate is secured to said header with a header fitting surface of said contacting piece fitted to an external surface of said header, and wherein said contacting piece is formed by bending a cut-part of a widthwise edge portion of said header inserting end portion.

2. The heat exchanger as recited in claim 1, wherein each of opposite end portions of said side plate is formed into a tapered shape having a width decreasing toward a tip thereof.

3. A heat exchanger comprising:

a hollow header having a plurality of tube fitting apertures arranged in line;

a plurality of tubes communicated with said header, each tube having one end fitted in a corresponding tube fitting aperture;

a fin disposed at an outside of an outermost tube; and a side plate disposed at an outside of said fin, wherein said header is further provided with a side plate fitting aperture having the same or approximately the same configuration as that of said tube fitting aperture, wherein a header insertion end portion of said side plate is formed into a cross-sectional peripheral configuration corresponding to a cross-sectional peripheral configuration of said side plate fitting aperture, wherein said header insertion end portion of said side plate is fitted in said side plate fitting aperture and secured thereto, wherein said side plate is provided with a header inserting portion having a contacting piece vertically extending relative to said side plate, and said side plate is secured to said header with a header fitting surface of said contacting piece fitted to an external surface of said header, and wherein said contacting piece is formed by bending a cut-part of a widthwise edge portion of said header inserting end portion.

4. The heat exchanger as recited in claim 3, wherein said fin is a corrugated fin constituted by an aluminum brazing sheet comprising a core member and brazing materials coated on one side or both sides of said core member.

5. The heat exchanger as recited in claim 3, wherein said contacting piece is extended toward an inside of said side plate.

6. The heat exchanger as recited in claim 3, wherein said header inserting end portion of said side plate is formed into a tapered shape having a width decreasing toward a tip thereof.

7. The heat exchanger as recited in claim 6, wherein said header inserting end portion of said side plate has a first tapered portion as an insertion guide at a tip end thereof and a second tapered portion for an insertion amount restricting portion at an inside position of said header inserting end portion.

8. The heat exchanger as recited in claim 3, wherein said side plate has a width which is the same or approximately the same as a width of said tube and a thickness which is the same or approximately the same as a height of said tube.

9. A heat exchanger comprising:

a pair of hollow headers arranged in parallel;

a plurality of tubes disposed between said headers and communicated with said headers with opposite end portions fitted in tube fitting apertures formed in opposed surfaces of said pair of headers;

fins disposed between adjacent tubes and at an outside of an outermost tube; and a side plate disposed at an outside of an outermost fin with opposite end portions fitted in side plate fitting apertures formed in opposed surfaces of said pair of headers, wherein a header insertion end portion constituting said both end portions of said side plate is formed into the same or approximately the same cross-sectional peripheral configuration as that of an end portion of said tube, wherein said side plate fitting aperture is formed into the same or approximately the same configuration as that of said tube fitting aperture, wherein said side plate is provided with a header inserting portion having a contacting piece vertically extending relative to said side plate, and said side plate is secured to said header with a header fitting surface of said contacting piece fitted to an external surface of said header, and wherein said contacting piece is formed by bending a cut-part of a widthwise edge portion of said header inserting end portion.

10. The heat exchanger as recited in claim 9, wherein said fin is a corrugated fin constituted by an aluminum brazing sheet comprising a core member and brazing materials coated on one side or both sides of said core member.

11. The heat exchanger as recited in claim 9, wherein said contacting piece is extended toward an inside of said side plate.

12. The heat exchanger as recited in claim 9, wherein said header inserting end portion of said side plate is formed into a tapered shape having a width decreasing toward a tip thereof.

13. The heat exchanger as recited in claim 12, wherein said header inserting end portion of said side plate has a first tapered portion as an insertion guide at a tip end thereof and a second tapered portion for an insertion amount restricting portion at an inside position of said header inserting end portion.

14. The heat exchanger as recited in claim 9, wherein said side plate has a width which is the same or approximately the same as a width of said tube and a thickness which is the same or approximately the same as a height of said tube.

* * * * *

UNITED STATES PATENT AND TRADEMARK OFFICE

CERTIFICATE OF CORRECTION

PATENT NO. : 6,691,772 B2
DATED : February 17, 2004
INVENTOR(S) : Hideaki Manaka It is certified that error appears in the above-identified patent and that said Letters Patent is hereby corrected as shown below:

Column 6,
Line 48, change “apertures” to -- aperture --.

Signed and Sealed this

Thirteenth Day of July, 2004

JON W. DUDAS
*Acting Director of the United States Patent and Trademark Office*